United States Patent [19]

Iwagami

[11] Patent Number: 4,586,839

[45] Date of Patent: May 6, 1986

[54] PAPER GUIDING DEVICE FOR PRINTER

[75] Inventor: Fusao Iwagami, Nara, Japan

[73] Assignee: Sharp Kabushiki Kaisha, Osaka, Japan

[21] Appl. No.: 577,353

[22] Filed: Feb. 6, 1984

[30] Foreign Application Priority Data

Feb. 15, 1983 [JP] Japan ..... 58-21358[U]

[51] Int. Cl.[4] ..... B41J 11/66

[52] U.S. Cl. ..... 400/619; 400/621; 400/642; 400/691

[58] Field of Search ..... 400/621, 642, 646, 647, 400/647.1, 578, 637.2, 689–690.4, 691, 693, 693.1, 716, 619

[56] References Cited

U.S. PATENT DOCUMENTS 4,483,635 11/1984 Wisner et al. ..... 400/642

FOREIGN PATENT DOCUMENTS 3405394 8/1984 Fed. Rep. of Germany ..... 400/621

*Primary Examiner*—Edgar S. Burr
*Assistant Examiner*—Moshe I. Cohen
*Attorney, Agent, or Firm*—Birch, Stewart, Kolasch & Birch

[57] ABSTRACT

A paper guide device for guiding a recording paper from a printing position to the upper and back direction of a platen, comprises an upper guide extending the width of the recording paper, a lower guide extending the width of the recording paper, and a path for passing the recording paper between the upper guide and the lower guide. The upper guide and the lower guide are disposed over the platen, and the upper guide is provided with a paper cutter for cutting the recording paper at the outlet of the forward path of the recording paper, and the lower guide is provided with means for guiding the recording paper in the lower direction along the platen, the recording paper having been inserted from the back of the platen.

8 Claims, 4 Drawing Figures

PRIOR ART

PAPER GUIDING DEVICE FOR PRINTER

BACKGROUND OF THE INVENTION

The present invention relates to a paper feed device and, more particularly to a paper guiding device which enables a recording paper (a roll paper) to be inserted easily around a platen and to be smoothly separated from the platen for recording.

A conventional paper feed device for a printer as shown in FIG. 1 comprises a platen 1, a printing head 2, a printer cover 3, a deflector 4 disposed under the platen 1, feed rollers 5, paper press rollers 6, a paper roll 7 for recording, and a paper cutter 8 disposed over the platen 1.

The feed rollers 5 and the paper press rollers 6 are contacted rotatably with the platen 1. The head of the roll paper 7 is forwarded along the printer cover 3 and is inserted between the platen 1 and the deflector 4, and after that, the paper from the roll is guided at the upper portion along the platen 1 after passing between the feed rollers 5 and the platen 1, and the paper from the roll 7 is conveyed at the upper side and the rear side of the platen 1 after passing between the paper press rollers 6 and the platen 1. Finally, the paper from the roll 7 is removed through the under side of the paper cutter 8.

In the above construction, when the paper from the roll 7 is cut by the paper cutter 8, the head of the paper which is cut away may hang in the direction of arrow A depending on the flexibility of the roll paper or the surrounding humidity condition.

If the paper from the roll 7 does overlap, as the paper roll 7 is advanced, the hanging paper can become jammed by the platen 1, causing the paper roll 7 to be stopped.

On the other hand, in the case where the paper roll 7 is hard and does not overhang in the direction of the arrow A, when the height of the printer cover 3 is higher than that of the paper cutter 8, the head of the paper from the roll 7 extends below the printer cover 3, and the paper from the roll 7 can become jammed by the platen 1.

SUMMARY OF THE INVENTION

In view of the above disadvantages of the conventional device, an object of the present invention is to provide an improved paper guiding device for smoothly separating a recording paper from a platen.

Another object of the present invention is to provide a paper guiding device for preventing the paper from hanging downwardly when a recording paper from a paper roll is cut by a paper cutter, and for smoothly guiding and/or separating the recording paper from a platen through a predetermined path.

Still another object of the present invention is to provide a paper guiding device for easily inserting a recording paper (a roll paper) around a platen.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to an embodiment of the present invention, a paper guide device for guiding a recording paper from a printing position to the upper and back direction of a platen, comprises upper guide means extended the width of the recording paper, lower guide means extended the width of the recording paper, and a path for directing the recording paper between the upper guide means and the lower guide means. The upper guide means and the lower guide means are disposed over the platen, and the upper guide means is provided with a paper cutting means for cutting the recording paper at the outlet of the forward path of the recording paper, and the lower guide means is provided with means for guiding the recording paper in the lower direction along the platen, the recording paper having been inserted from the back of the platen.

The paper guide device according to the embodiment of the present invention can be applied to a printer or a typewriter or the like.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
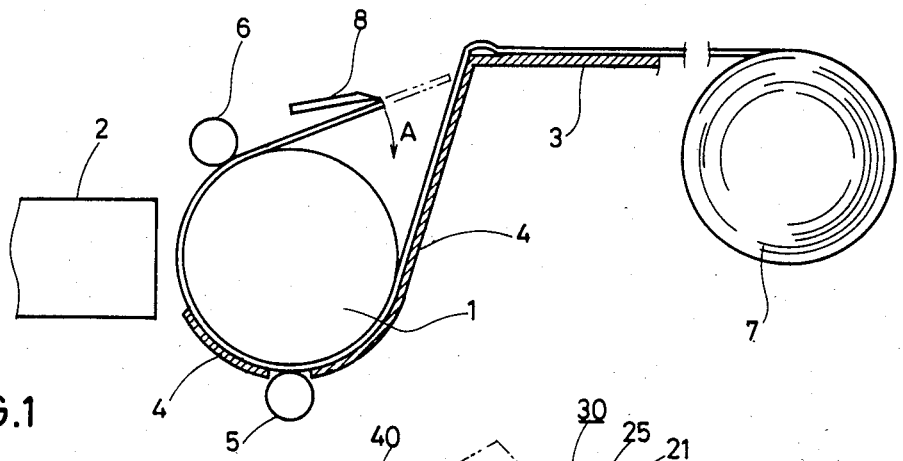
FIG. 1 is a sectional view of the conventional paper feed device.
Figure 2:
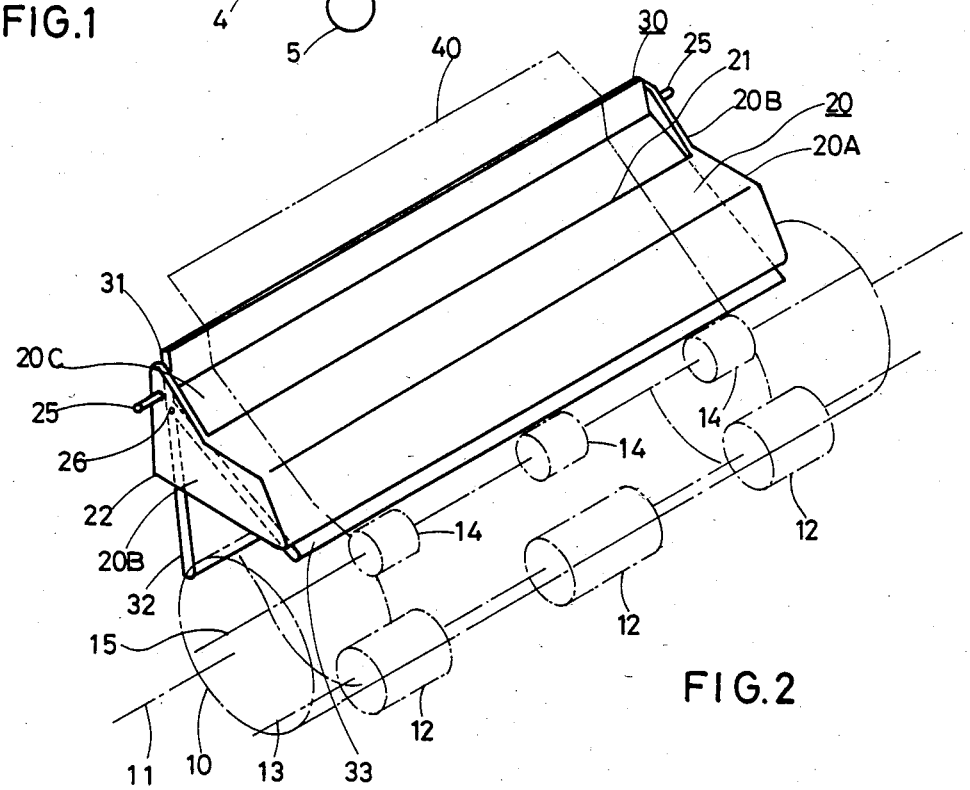
FIG. 2 is a perspective view of a paper feed device according to an embodiment of the present invention.

Reffering to FIG. 2, there is illustrated a perspective view of a paper feed device according to an embodiment of the present invention, which comprises a platen 10, a plurality of feed rollers 12, a plurality of paper press rollers 14, an upper paper guide 20, a lower paper guide 30.

The paper guide system comprises the upper paper guide 20 and the lower paper guide 30.

Figure 3:
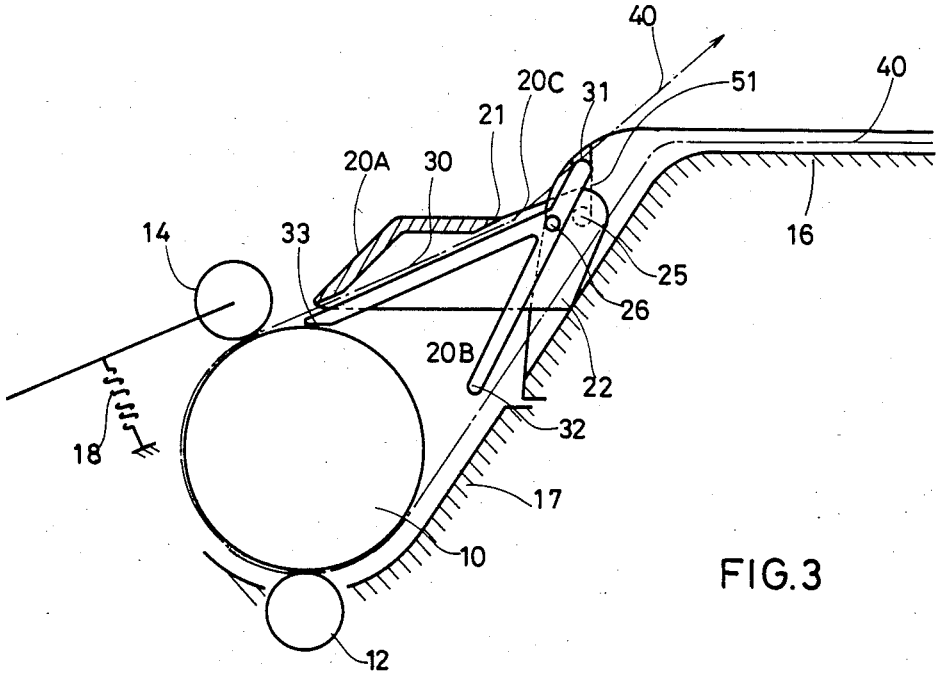
FIG. 3 is a sectional view of a paper feed device of FIG. 2.
Figure 4:
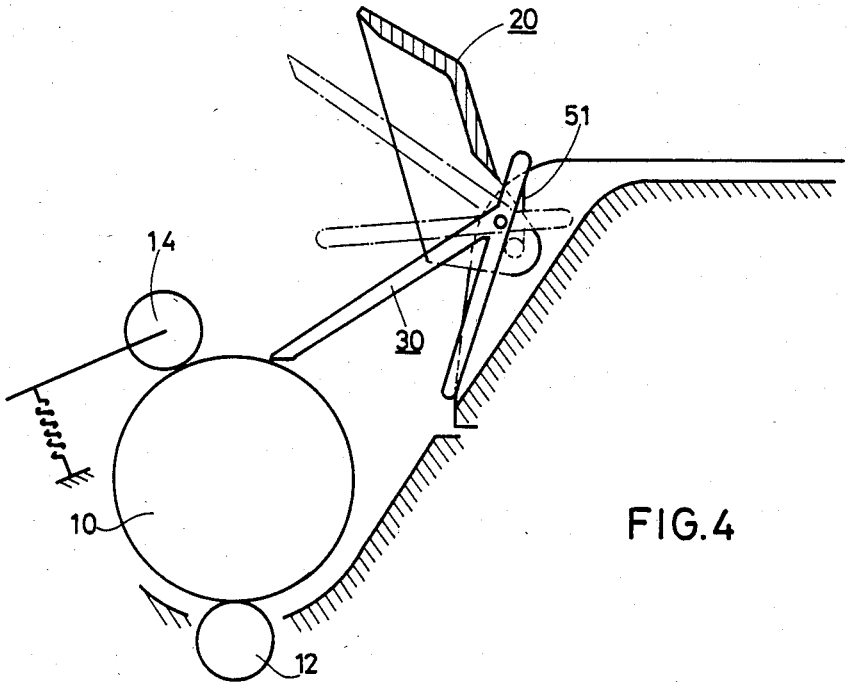
FIG. 4 is a sectional view of the paper feed device of FIGS. 2 and 3, showing the movement of a paper guiding device.

In FIGS. 2, 3, and 4, the platen 10 is rotated around an axis 11 (as indicated by a chain line) by a rotating mechanism not shown. The plurality of feed rollers 12 positioned under the platen 10 are rotatably provided around an axis 13 (as indicated by a chain line) parallel with the axis 11 of the platen 10, and the feed rollers 12 are in contact with the surface of the platen 10. The plurality of paper press rollers 14 positioned above the platen 10 are rotatably provided around an axis 15 (as indicated by a chain line) parallel with the axis 11 of the platen 10. The paper press rollers 14 can be detached from the surface of the platen 10 by a manual lever not shown. Usually, the paper press rollers 14 press a recording paper around the platen 10 by a spring 18 as shown in FIG. 3. Accordingly, when the platen 10 is rotated, the recording paper 40 is forwarded in response to the rotation of the platen 10 because the recording paper 40 is pressed by the feed rollers 12 and the paper press rollers 14.

Also, as shown in FIG. 3, 16 designates an upper cover for the printer and 17 designates a deflector disposed under the platen 10.

On the other hand, as shown in FIG. 2, the paper guide device (as indicated by a true line) comprising the upper paper guide 20 and the lower paper guide 30, is provided over the platen 10.

The upper paper guide 20 comprises an upper plate 20A having a bent shape extended the width direction of the platen 10, side plates 20B and 20B, and a rear opening 20C. The side plates 20B and 20B of the upper paper guide 20 are provided with support axes 25 and 25 projected in both side directions, respectively. As shown in FIG. 3, the support axes 25 and 25 are detachably engaged with upright grooves 51 and 51 formed on both sides of the upper cover 16. Accordingly, the upper paper guide 20 is detachably and rotatably provided on the printer by the support axes 25 and 25.

An upper edge (the position facing to the opening 20C) of the upper plate 20A is provided with a cutter edge 21 having teeth for cutting the recording paper 40.

On the other hand, the sectional view of the lower paper guide 30 has the shape of a reverse "Y". The lower paper guide 30 comprises a projection plate 33 extended the width of the platen 10 and extending over the platen 10 in the width direction of the platen 10, an overhanging portion 32 extending over the back of the platen 10 in the lower direction of the platen 10, and a guide plate 31 projected in the upper direction from the connection between the projection plate 33 and the overhanging portion 32.

When the guide plate 31 of the lower paper guide 30 is inserted into the opening 20C, support axes 26 and 26 projected on both sides of the connection between the projection plate 33 and the overhanging portion 32, are rotatably and detachably engaged with openings of the side plates 20B and 20B of the upper paper guide 20. Accordingly, the upper paper guide 20 and the lower paper guide 30 are integrated as the paper guide device.

When the paper guide device is integrated with the printer, the support axes 25 and 25 of the paper guide device are rotatably and detachably engaged in the upright grooves 51 and 51 of the side surfaces of the upper cover 16, and the paper guide device is installed in the upright grooves 51 and 51 of the both sides of the upper cover 16.

In this case, as shown in FIG. 3, the under ends 22 of the side plates 20B and 20B of the upper paper guide 20 are in contact with the slope surface of the upper cover 16, and the upper plate 20A of the upper paper guide 20 is rotated a little in the upward direction, so that a space for passing the recording paper 40 is provided between the upper plate 20A and the projection plate 33 of the lower paper guide 30.

Accordingly, after the recording paper 40 is passed between the paper press rollers 14 and the platen 10, the recording paper 40 is guided in the upper direction by the guide 31 through the opening 20C and forwarded to the upper side of the printer.

In the above construction, as shown in FIG. 4, in the case where the recording paper 40 is installed, the upper paper guide 20 is lifted up manually and rotated around the support axes 25 and 25 in the upper direction, and the recording paper 40 is inserted between the upper cover 16 and the overhanging portion 32. After inserting the recording paper 40, the upper paper guide 20 is returned to the original position.

And after that, the recording paper 40 is further forwarded along the deflector 17, and positioned between the feed rollers 12 and the platen 10.

After the paper press rollers 14 are separeted from the platen 10 and, then, the recording paper 40 is guided between the paper press rollers 14 and the platen 10, the recording paper 40 is inserted into the path between the projection plate 33 and the upper plate 20A of the paper guide device as shown in FIG. 3. Also, the paper press rollers 14 are returned to be in contact with the platen 10.

The recording operation is carried out in the condition of FIG. 3. When recording, the recording paper 40 is forwarded continuously or sequentially by the rotation of the platen 10.

In this case, the head of the recording paper 40 is guided through the path formed by the upper plate 20A and the projection plate 33 and guided by the guide 31 in the upward direction, so that the recording paper 40 travels over the guide 31 and forwarded in the upward direction of the printer.

On the other hand, if the lower paper guide 30, as indicated by a chain line of FIG. 4 is rotated, the platen 10 can be detached easily for repairing, and if necessary, the paper guide device can be removed when the paper guide device is lifted in the upward direction and the support axes 25 and 25 are removed from the upright grooves 51 and 51.

In the embodiment of the present invention, a roll paper is used as the recording paper. However, other recording paper can be also used.

The paper guide device according to the embodiment of the present invention can be applied to the printer, a typewriter or the like.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A paper guide device for guiding a recording paper from a printing position of a printer, provided over a platen, comprising:

upper guide means comprising an upper plate and side plates extending across the width of the recording paper above the platen, rotatably and detachably associated with the printer; and lower guide means extending across the width of the recording paper above the platen beneath the upper plate of said upper guide means within the side plates and rotatably supported by said side plates;

said upper guide means and lower guide means defining a path for passing the recording paper between said upper guide means and said lower guide means.

2. The paper guide device of claim 1, wherein the upper guide means is provided with a paper cutting means for cutting the recording paper at an outlet of the path of the recording paper from said paper guide device.

3. The paper guide device of claim 1, wherein the recording paper is a roll paper.

4. The paper guide device of claim 1, wherein said upper plate of said upper guide means has a bent slope and said upper guide means further comprises a rear opening for passage of said recording paper and said lower guide means comprises a projection plate, an overhang portion and a guide plate which projects upward through said rear opening from a connection between said projection plate and said overhang portion, said projection plate acting as a guide for said paper leaving said platen and said overhang portion acting as a guide for said paper being introduced to said platen.

5. A printer comprising:

a platen;

recording paper;

a paper guide deivce for guiding said recording paper from a printing position of said printer, said paper guide device being provided over said platen, said paper guide device comprising upper guide means comprising upper plate and side plates extending across the width of the recording paper above the platen, rotatably and detachably associated with the printer and lower guide means extending across the width of the recording paper above the platen beneath the upper plate of said upper guide means within the side plates and rotatably supported by said side plates said upper guide means and lower guide means defining a path for passing the recording paper between said upper guide means and said lower guide means.

6. The printer device of claim 5, wherein said upper plate of said upper guide means has a bent slope and said upper guide means further comprises a rear opening for passage of said recording paper and said lower guide means comprises a projection plate, an overhang portion and a guide plate which projects upward through said rear opening from a connection between said projection plate and said overhang portion, said projection plate acting as a guide for said paper leaving said platen and said overhang portion acting as a guide for said paper being introduced to said platen.

7. A typewriter comprising:

a platen;

recording paper;

a paper guide device for guiding said recording paper from a printing position of said printer, said paper guide device being provided over said platen, said paper guide device comprising upper guide means comprising upper plate and side plates extending across the width of the recording paper above the platen, rotatably and detachably associated with the printer and lower guide means extending across the width of the recording paper above the platen beneath the upper plate of said upper guide means within the side plates and rotatably supported by said side plates said upper guide means and lower guide means defining a path for passing the recording paper between said upper guide means and said lower guide means.

8. The typewriter device of claim 7, wherein said upper plate of said upper guide means has a bent slope and said upper guide means further comprises a rear opening for passage of said recording paper and said lower guide means comprises a projection plate, an overhang portion and a guide plate which projects upward through said rear opening from a overhang portion, said projection plate acting as a guide for said paper leaving said platen and said overhang portion acting as a guide for said paper being introduced to said platen.

* * * * *